US009920632B2

(12) United States Patent
Dupeyre et al.

(10) Patent No.: US 9,920,632 B2
(45) Date of Patent: Mar. 20, 2018

(54) MOVING TURBINE BLADE

(71) Applicant: SNECMA, Paris (FR)

(72) Inventors: Raphael Dupeyre, Levallois-Perret (FR); Josserand Bassery, Courbevoie (FR); Vincent François Boulay, Paris (FR)

(73) Assignee: SNECMA, Paris (FR)

( * ) Notice: Subject to any disclaimer, the term of this patent is extended or adjusted under 35 U.S.C. 154(b) by 273 days.

(21) Appl. No.: 14/419,068

(22) PCT Filed: Jul. 19, 2013

(86) PCT No.: PCT/FR2013/051748

§ 371 (c)(1),
(2) Date: Feb. 2, 2015

(87) PCT Pub. No.: WO2014/020258

PCT Pub. Date: Feb. 6, 2014

(65) Prior Publication Data

US 2015/0218950 A1 Aug. 6, 2015

(30) Foreign Application Priority Data

Aug. 3, 2012 (FR) ..... 12 57602

(51) Int. Cl.
*F01D 5/14* (2006.01)

(52) U.S. Cl.
CPC ..... *F01D 5/147* (2013.01); *F01D 5/141* (2013.01); *F05D 2240/301* (2013.01); *F05D 2250/71* (2013.01)

(58) Field of Classification Search
CPC . F01D 5/141; F01D 5/147; F01D 5/14; F05D 2250/71; F05D 2240/301
USPC ..... 416/210 A, 223 A, 226, 234
See application file for complete search history.

(56) References Cited

U.S. PATENT DOCUMENTS 5,980,209 A * 11/1999 Barry ..... F01D 5/141 416/193 A
6,722,851 B1 * 4/2004 Brittingham ..... F01D 5/141 415/115
6,854,961 B2 * 2/2005 Zhang ..... F01D 5/141 416/223 A (Continued)

FOREIGN PATENT DOCUMENTS

| | | |
|---|---|---|
| EP | 0 887 513 | 12/1998 |
| EP | 1 698 760 | 9/2006 |
| EP | 2 374 999 | 10/2011 |

OTHER PUBLICATIONS

International Search Report issued in International Patent Application No. PCT/FR2013/051748, dated Dec. 4, 2013.

*Primary Examiner* — Matthew W Jellett
(74) *Attorney, Agent, or Firm* — Pillsbury Winthrop Shaw Pittman LLP

(57) ABSTRACT

A moving blade of a low pressure turbine includes a foot and a vane having an upper surface and a lower surface, the foot having a stilt linking the vane to the foot, wherein the stilt is formed such that the transverse section of the stilt has: a first straight portion, a second curved portion and a third straight portion, the curved portion having an outer face matching the profile of the upper surface of the vane and an inner face matching the profile of the lower surface of the vane.

9 Claims, 1 Drawing Sheet

(56) References Cited

U.S. PATENT DOCUMENTS

| | | | | |
|---|---|---|---|---|
| 6,857,855 | B1 * | 2/2005 | Snook | F01D 5/141 416/223 A |
| 7,632,072 | B2 * | 12/2009 | Sheffield | F01D 5/141 416/189 |
| 2006/0193726 | A1 * | 8/2006 | Caruso | F01D 5/225 416/204 R |
| 2011/0243746 | A1 * | 10/2011 | Liotta | F01D 5/282 416/214 R |

* cited by examiner

MOVING TURBINE BLADE

CROSS REFERENCE TO RELATED APPLICATIONS

This application is the U.S. National Stage of PCT/FR2013/051748, filed Jul. 19, 2013, which in turn claims priority to French Patent Application No. 1257602 filed Aug. 3, 2012, the entire contents of all applications are incorporated herein by reference in their entireties.

TECHNICAL FIELD OF THE INVENTION

The field of the invention relates to moving blades in a low pressure turbine of a turbomachine.

The invention more particularly relates to a particular arrangement of the foot of a moving blade of a low pressure turbine.

TECHNICAL BACKGROUND OF THE INVENTION

Conventionally, as shown in FIG. 1, a moving blade 1 of a low pressure turbine is composed of three assemblies: a lower part called the foot 10, an upper part called the heel 20 and a central part formed by the vane 30.

The foot 10 of the mobile blade 1 is composed of three functional elements:

- a shank 11 making the connection between the vane and the foot 10;
- a bulb 12 making the mechanical connection between the mobile blade and a turbine rotor disk;
- spoilers 13 reducing leaks to maximise the efficiency of the low pressure turbine.

The shank 11 is an important part of the foot 10 because it maintains the mechanical connection between the vane 30 and the foot 10 that is fixed to the rotor disk and is consequently the location at which there are high mechanical stresses.

Conventionally, mobile blades of the low pressure turbine have shanks that are approximately straight corresponding to the shape of the top part of the bulb (i.e. the top part of the dovetail).

However, such shanks cannot satisfy the required mechanical requirements in some geometric configurations, particularly in the presence of complex shaped vanes.

In such situations, curved shanks have been developed that have the same shape or more precisely the same profile as the vane so as to provide maximum overlap between the shank 11 and the vane 30 or more precisely between the profile of the cross-section of the shank 11 and the profile of the cross-section of the vane 30.

The development of this type of shank configuration has made stresses in this part of the blade uniform but has also contributed to increasing the mass of blades and consequently of the low pressure turbine. It will clearly be understood that an increase of a few grams in the mass of a mobile blade would have the consequence of increasing the mass of the entire turbine that comprises a plurality of stages, each stage being formed by several hundred mobile blades, by several kilograms.

GENERAL DESCRIPTION OF THE INVENTION

In this context, the invention discloses a moving low pressure turbine blade that is lighter in weight than moving blades according to the state of the art and that can resist imposed mechanical stresses.

To achieve this, the invention discloses a moving blade of a low pressure turbine with a foot and a vane with an outer face and an inner face, said foot having a shank connecting the vane to the foot; said blade being characterised in that said shank is formed such that the cross-section of said shank has a first straight portion, a second curved portion and a third straight portion, said curved portion having an external face corresponding to the profile of the outer face of said vane and an internal face corresponding to the profile of the inner face of said vane.

With the invention, the mass of the turbine is reduced while good mechanical strength is maintained.

Advantageously, said straight portions are located on each side of said curved portion.

Advantageously, the lengths of the different portions are adjusted as a function of the required mechanical properties. It is thus possible to modify the length of the curved portion relative to the straight portions so as to further improve the mechanical properties of the foot.

Advantageously, said curved portion is defined such that the cross-section of the curved portion is superposed on the cross-section of the bottom of the vane with an overlap of more than 95%.

Advantageously, each of said portions of the shank has a constant thickness.

Another purpose of the invention is a low pressure turbine with a plurality of moving blades according to the invention.

The invention will be better understood after reading the following description with reference to the figures, the list of which is given below.

DETAILED DESCRIPTION OF EMBODIMENTS OF THE INVENTION

Figure 2:
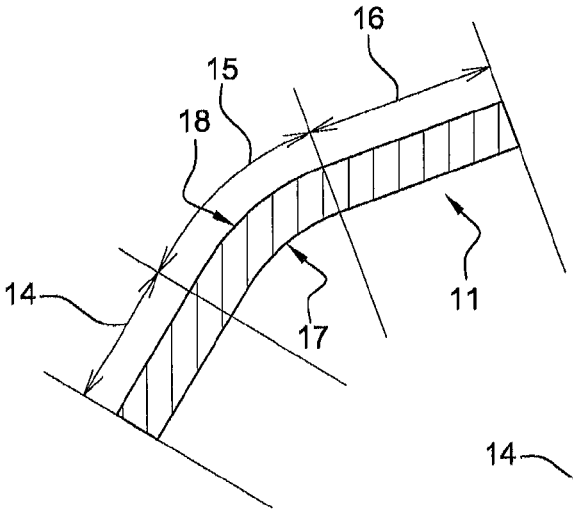
FIG. 2 diagrammatically shows a sectional view on a cross-sectional plane of a shank of a moving blade according to the invention.

With reference to FIG. 2, the shank 11 has a cross-section broken down into three distinct portions:

- a first straight portion 14;
- a second curved portion 15;
- a third portion 16 that is once again straight.

The curved portion 15 is located between the two straight portions 14 and 16. Each portion 14, 15, 16 has a constant thickness.

Figure 3:
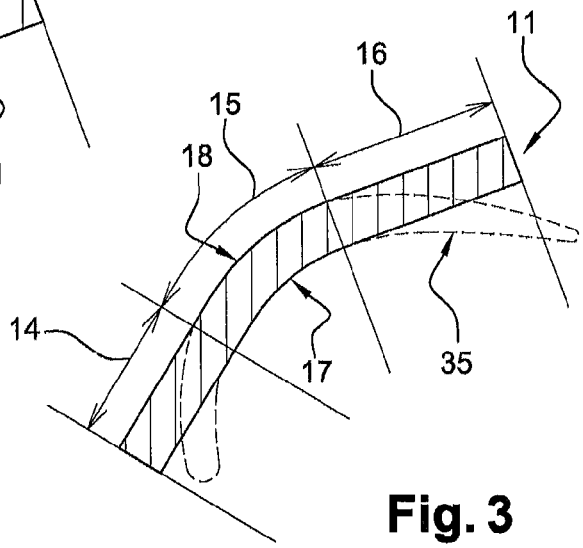
FIG. 3 shows a superposition of the section shown in FIG. 2 with the section of the vane of the blade according to the invention on a cross-sectional plane parallel to the cross-sectional plane of the shank.

As shown in FIG. 3, the geometric shape of the shank 11 of the blade according to the invention comprises a curved portion 15 that matches a portion of the profile 35 of the bottom of the vane 30 of the blade shown in dashed lines in FIG. 3. The bottom of the vane means the portion of the vane connected to the shank.

Figure 1:
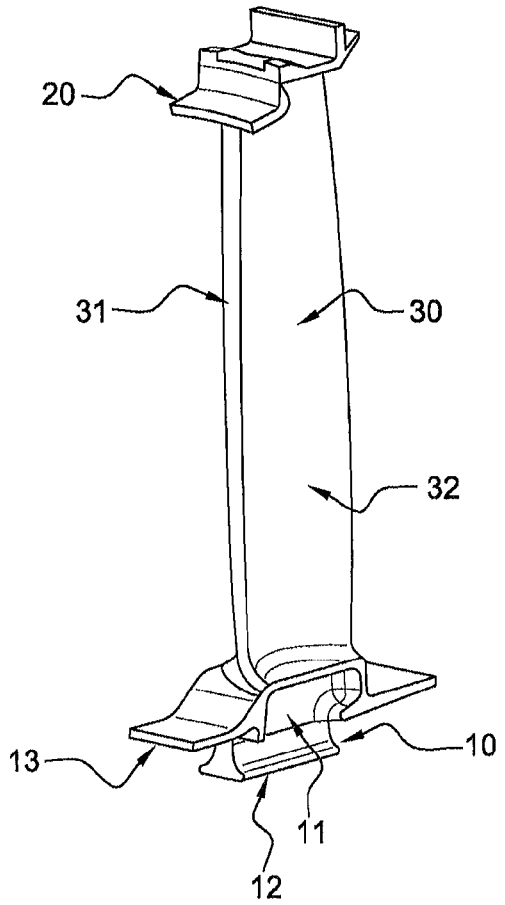
FIG. 1 described above shows a moving blade of a low pressure turbine.

The two profiles at the curved portion 15 are identical, in other words the external face 18 of this curved portion 15 has the same profile as the outer face 31 of the bottom of the vane 30 (shown in FIG. 1) and the internal face 17 has the same profile as the inner face of the bottom of the vane 30 (FIG. 1). Advantageously, this portion 15 has the same thickness as the bottom of the corresponding vane 30 such that the two profiles are superposed.

The lengths of the different portions 14, 15 and 16 of the shank 11 may be variable and adapted as a function of the required mechanical properties. The proportion of the curved portion 15 can be increased at the detriment of the straight portions 14, 16 if the foot 10 of the blade is required to have better resistance to the imposed mechanical stresses. Thus, the different lengths can be modulated and should be optimised depending on the required weight/resistance ratio. For example, the shape of the shank 11 is determined by successive iterations using a CAD model and thermomechanical calculations.

The shank 11 is thus developed such that the curved portion 15 overlaps with the cross-section of the vane 30 by at least 95% and advantageously by 100%. For example, a complete overlap of the order of 65 to 75% between the section of the vane and the section of the shank can give sufficient mechanical robustness for an application in the field of low pressure turbines, while creating a saving in the mass.

According to one embodiment example in the field of low pressure turbines, the profile of the shank comprises:

- a first straight portion 14 with a length of 2 mm;
- a curved portion 15 with a chord length of 10 mm at the outer face profile, and a chord length of 8 mm at the inner face profile;
- a third straight portion 16 with a length of 4 mm at the outer face and a length of 6 mm at the inner face.

The thickness of the shank profile is constant and is equal to 2 mm. Thus, with such a profile, the overlap ratio of the shank and the bottom of the vane is 85%.

The invention claimed is:

1. A moving blade of a low pressure turbine comprising a foot and a vane with an outer face and an inner face, said foot having a shank connecting the vane to the foot, wherein said shank is formed such that a cross-section of said shank has a first straight portion, a second curved portion and a third straight portion, said second curved portion having an external face, which has a same profile as that of the outer face at a bottom of said vane, and an internal face, which has a same profile as that of the inner face at the bottom of said vane.

2. The moving blade according to claim 1, wherein said first and third straight portions are located on each side of said second curved portion.

3. The moving blade according to claim 1, wherein said second curved portion is defined such that a cross-section of the second curved portion is superposed on a cross-section of the vane with an overlap of more than 95% of the cross-sectional area of the second curved portion.

4. The moving blade according to claim 1, wherein each of said first, second and third portions has a constant thickness.

5. A low pressure turbine of a turbomachine, comprising a plurality of moving blades, each of the plurality of moving blades comprising a foot and a vane with an outer face and an inner face, said foot having a shank connecting the vane to the foot, wherein said shank is formed such that a cross-section of said shank has a first straight portion, a second curved portion and a third straight portion, said second curved portion having an external face, which has a same profile as that of the outer face at a bottom of said vane, and an internal face, which has a same profile as that of the inner face at the bottom of said vane.

6. The moving blade according to claim 1, wherein the first, second and third portions have a same thickness.

7. The low pressure turbine according to claim 5, wherein said first and third straight portions are located on each side of said second curved portion.

8. The low pressure turbine according to claim 5, wherein said second curved portion is defined such that a cross-section of the second curved portion is superposed on a cross-section of the vane with an overlap of more than 95% of the cross-sectional area of the second curved portion.

9. The low pressure turbine according to claim 5, wherein the first, second and third portions have a same thickness.

* * * * *